US011459874B1

(12) United States Patent
Stair et al.

(10) Patent No.: US 11,459,874 B1
(45) Date of Patent: Oct. 4, 2022

(54) SHOE TRACK ASSEMBLY SYSTEM AND METHOD OF USE

(71) Applicants: Todd Stair, Houston, TX (US); Henry E. Rogers, Houston, TX (US); Jimmy Venizelos, Houston, TX (US); Carlos Valdez, Houston, TX (US)

(72) Inventors: Todd Stair, Houston, TX (US); Henry E. Rogers, Houston, TX (US); Jimmy Venizelos, Houston, TX (US); Carlos Valdez, Houston, TX (US)

( * ) Notice: Subject to any disclaimer, the term of this patent is extended or adjusted under 35 U.S.C. 154(b) by 0 days.

(21) Appl. No.: 16/442,802

(22) Filed: Jun. 17, 2019

Related U.S. Application Data

(60) Provisional application No. 62/827,642, filed on Apr. 1, 2019.

(51) Int. Cl.

| | |
|---|---|
| ***E21B 47/117*** | (2012.01) |
| ***E21B 33/12*** | (2006.01) |
| ***E21B 33/16*** | (2006.01) |
| ***E21B 34/06*** | (2006.01) |

(52) U.S. Cl.
CPC ..... *E21B 47/117* (2020.05); *E21B 33/12* (2013.01); *E21B 33/16* (2013.01); *E21B 34/06* (2013.01)

(58) Field of Classification Search
CPC ..... E21B 17/043; E21B 47/117; E21B 33/12; E21B 33/16; E21B 34/06; E21B 17/06; E21B 21/10; E21B 33/146
See application file for complete search history.

(56) References Cited

U.S. PATENT DOCUMENTS

| | | | | |
|---|---|---|---|---|
| 5,732,775 | A * | 3/1998 | Hudson | E21B 17/043 166/177.4 |
| 9,297,230 | B2 * | 3/2016 | Stair | E21B 33/14 |
| 10,487,618 | B2 * | 11/2019 | Budde | E21B 33/16 |
| 2015/0101801 | A1 * | 4/2015 | Budde | E21B 34/10 166/250.01 |
| 2018/0112487 | A1 * | 4/2018 | Budde | E21B 43/10 |
| 2018/0112488 | A1 * | 4/2018 | Budde | E21B 23/02 |
| 2020/0095840 | A1 * | 3/2020 | Gill | E21B 33/12 |

* cited by examiner

*Primary Examiner* — Daniel P Stephenson
(74) *Attorney, Agent, or Firm* — Leavitt Eldredge Law Firm

(57) ABSTRACT

A shoe track assembly system includes an elongated casing body extending from a first end to a second end and having a guide nose engaged with the second end; a first valve secured within the elongated casing body and at a position directly above the guide nose; a bottom plug landing seat extending into the elongated casing body at a position above the first valve; and a top plug landing seat extending into the elongated casing body at a position above the bottom plug landing seat; the system is to receive casing pressure test and act as a wall barrier system preventing cement or formation fluid from entering the casing without relying on shoe track cement integrity.

6 Claims, 7 Drawing Sheets

SHOE TRACK ASSEMBLY SYSTEM AND METHOD OF USE

BACKGROUND

1. Field of the Invention

The present invention relates generally to wellbore shoe track systems, and more specifically, to a shoe track assembly system for increasing efficiency and eliminating a plurality of components of conventional systems, thereby reducing the cost associated with the wellbore system as a whole as well as increase the productivity.

2. Description of Related Art

Well drilling systems are well known in the art and are effective means to collect resources for energy use. For example, FIG. 1 depicts a flowchart of a conventional well drilling operation. Conventional operations utilize a shoe track that is spaced in intervals of casing joints, and extending from a float shoe at the bottom to a top plug/landing collar at the top, and having a plurality of casing threads between the components, as shown with boxes 103, 105. Cementing operations are performed to create cement integrity around the casing shoe, which provides structural strength necessary to support continued drilling, as shown with box 107. As is known in the art, pressure testing is completed to ensure strength of the casing string, as shown with box 109. After such pressure testing, continued well operations can be performed as is known in the art and desired by the user, as shown with box 111.

One of the problems commonly associated with conventional systems and methods is cost and efficiency. For example, the conventional shoe track utilizes a plurality of casing joints and can extend to 160 feet in length. Each casing joint increases the cost of operation and decreases the efficiency of operation. Accordingly, it is desirable to provide a system that can reduce the number of casing threads and reduce the overall length associated with the shoe track, thereby gaining efficiency associated with the wellbore operation.

The system of the present invention utilizes a system that includes a single tool that can be approximately 5 feet long, thereby drastically reducing the number of components needed for the well drilling operation, which reduces the cost and improves efficiency.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
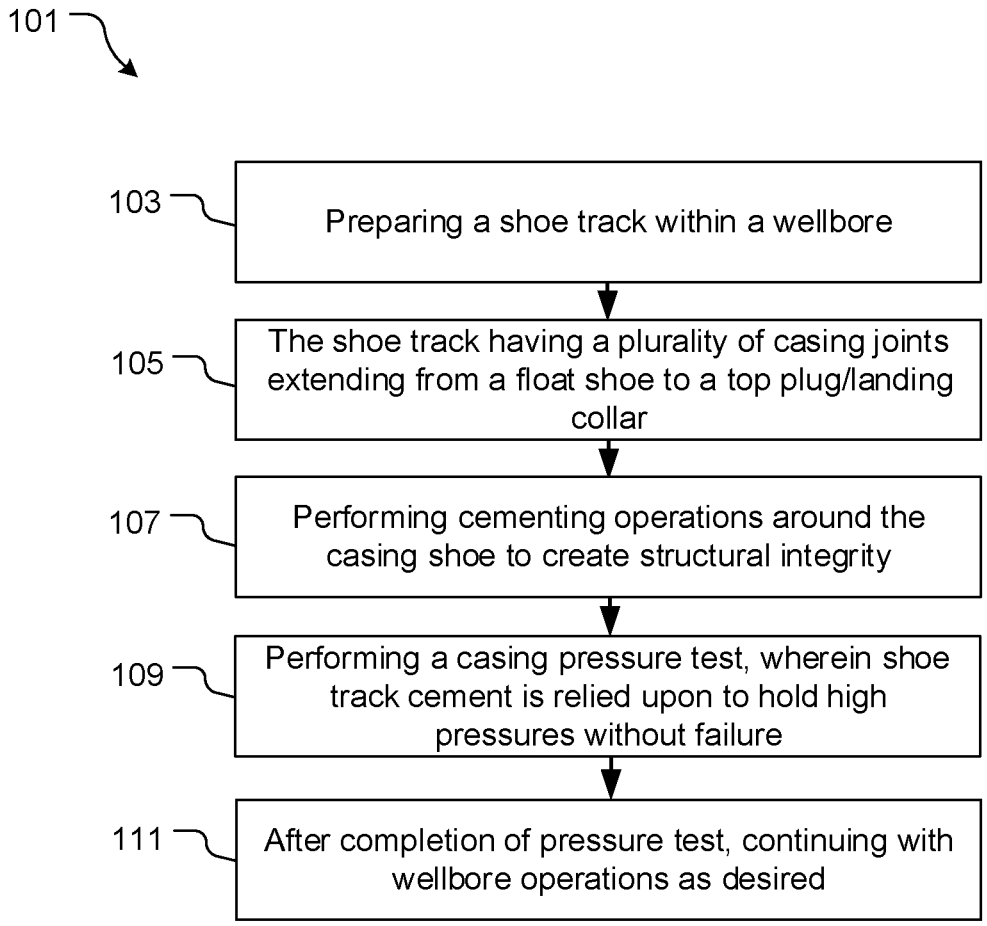
FIG. 1 (Prior Art)
FIG. 1 is a flowchart of a common well drilling operation.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wellbore operations. Specifically, the present invention provides for a wellbore integrity and barrier system with a single tool that is approximately 5 feet in length that can be utilized for pressure testing operations and eliminates the need for a plurality of casing sections joined by casing joints, as is known in the art. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
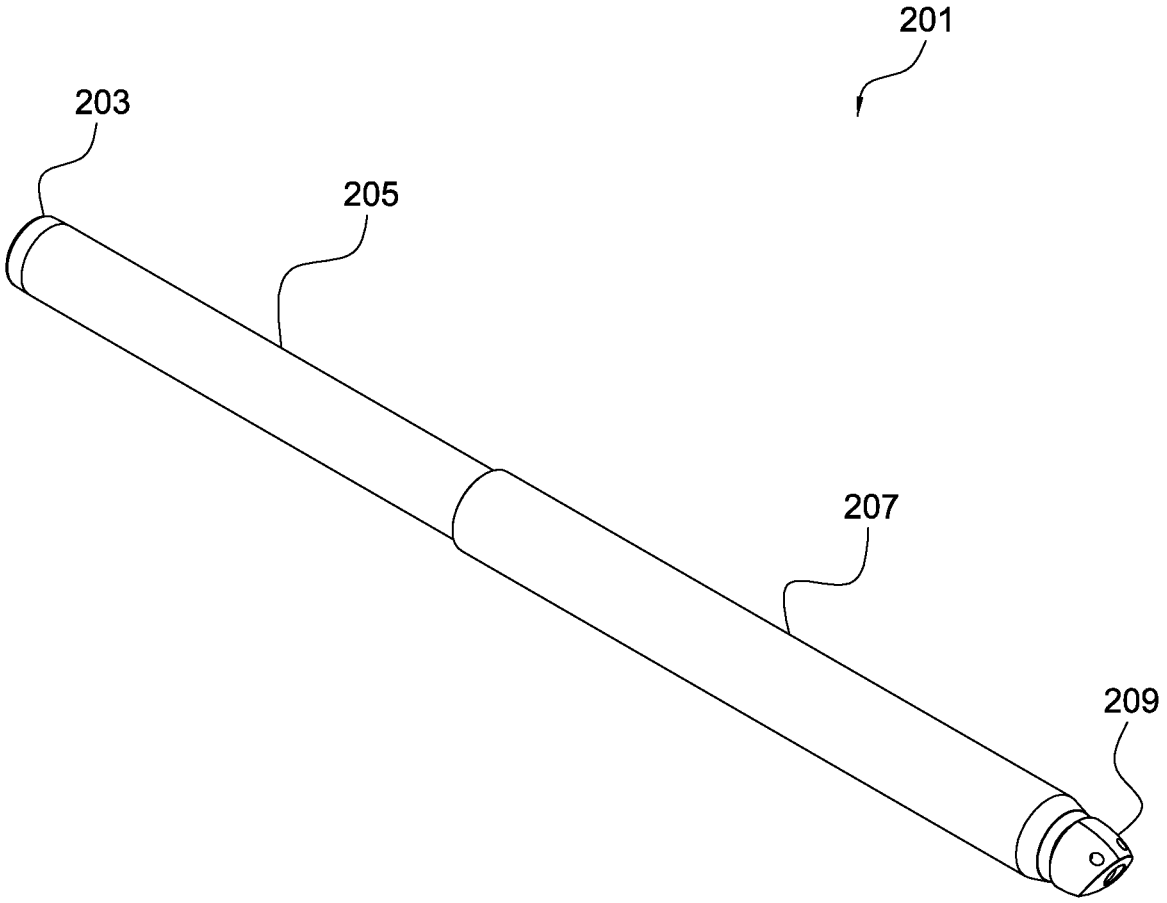
FIG. 2 is an isometric view of a shoe track tool in accordance with a preferred embodiment of the present application.
Figure 3:
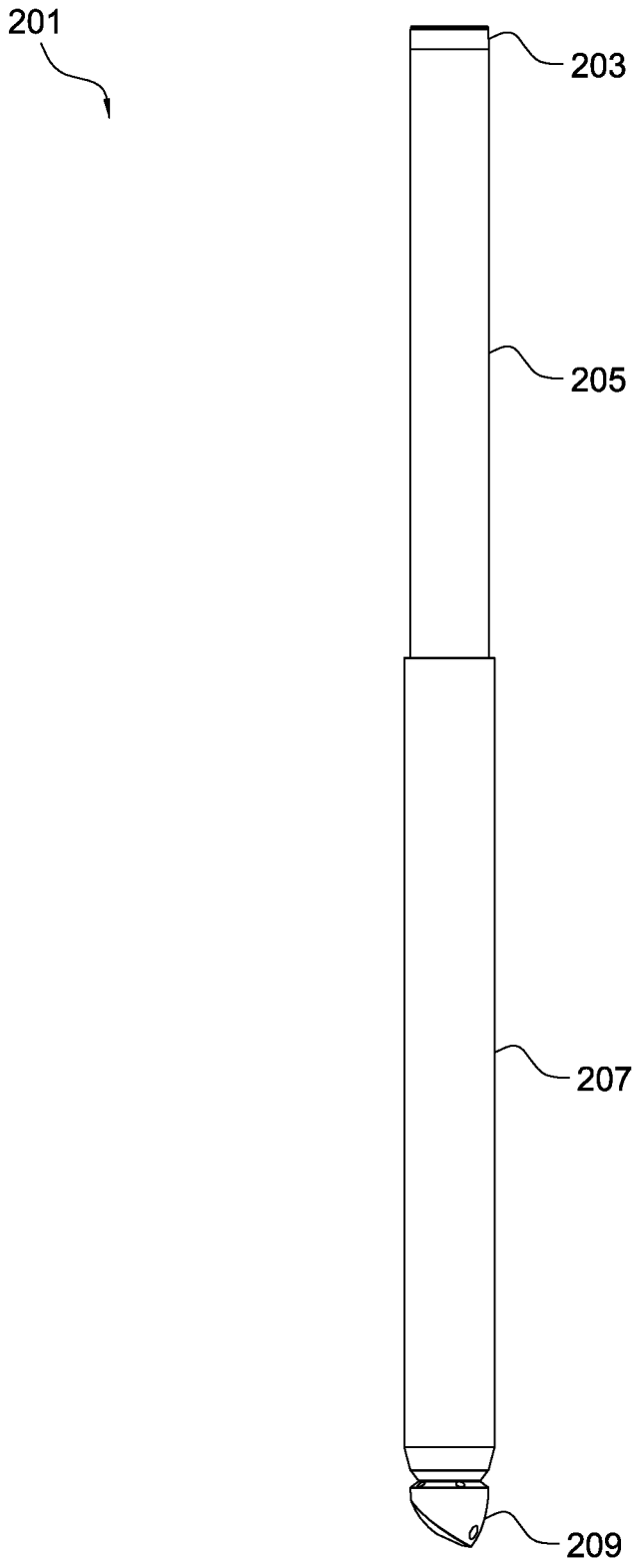
FIG. 3 is a front view of the tool of FIG. 2.

Referring now to the drawings wherein like reference characters identify corresponding or similar elements throughout the several views, FIGS. 2 and 3 depict isometric and front views of tool 201 in accordance with a preferred embodiment of the present application. It will be appreciated that tool 201 provides a means to improve efficiency associated with wellbore operations.

In the contemplated embodiment, tool 201 includes a housing 207 secured to a casing 203, 205 at a single connection, wherein the housing 207 extends from the casing to a guide nose 209. It should be appreciated that the guide nose can vary as desired by the operator. In the preferred embodiment, the housing is approximately five (5) feet in length, however, it should be appreciated that moderate variations from this length could be used and provide the same benefits as the tool described herein.

Figure 4:
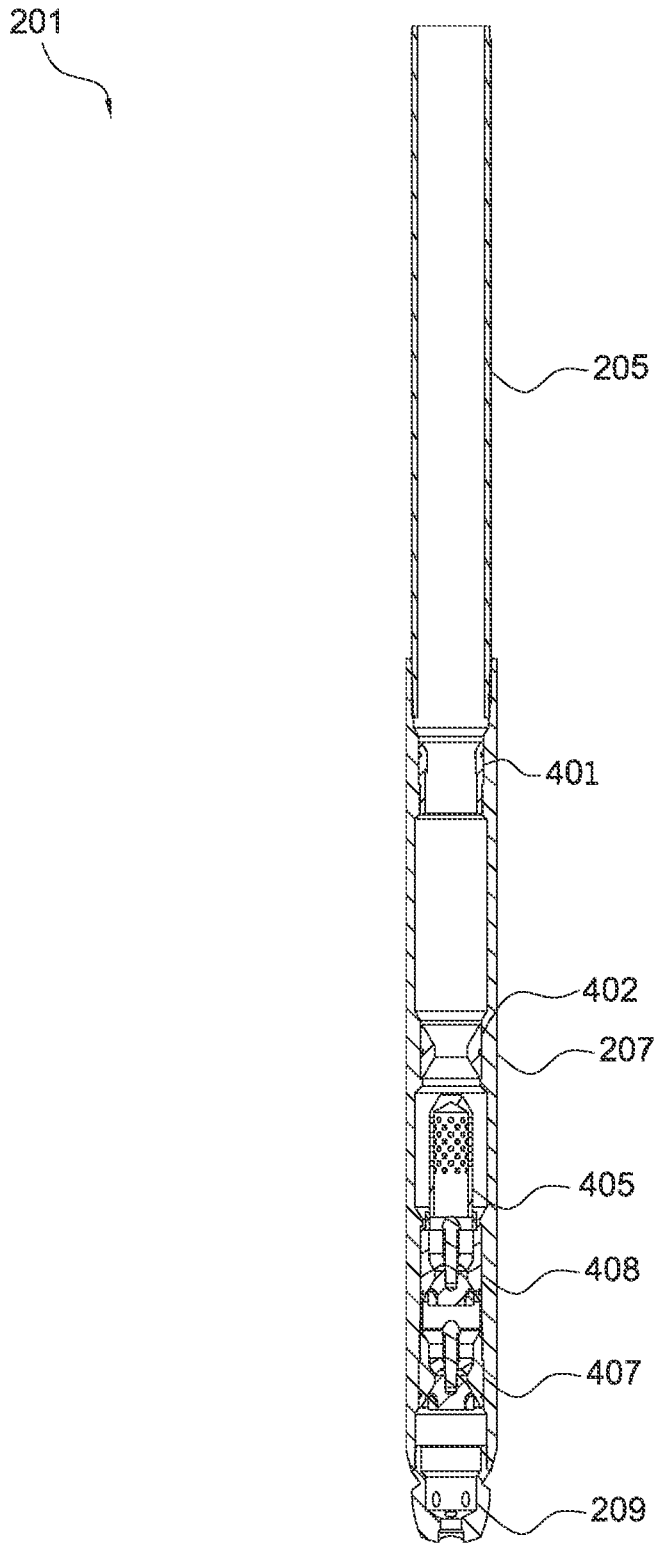
FIG. 4 is a front cross-sectional view of the tool of FIG. 2.

In FIG. 4, a cross sectional view further depicts the interior components of tool 201. Tool 201 including a first valve 407 and a second valve 408, the first and second valves positioned above the guide nose and providing a seal within the elongated body and configured to withstand extreme pressure. It should be appreciated that additional valves could be used within the housing. In one particular embodiment, the first and second valves are 15 ksi gas-tight float valves, however, it is contemplated and should be appreciated that alternative embodiments could include alternative valves known or developed in the future that provide sealing capabilities within the elongated body.

As further shown, tool 201 further includes a bottom plug landing seat 402, being at a position above the valves 407, 408 and extending into the interior area of the housing. The bottom plug landing seat 402 is configured to receive and engage with a bottom plug 403, as is known in the art.

Tool 201 further includes a top plug landing seat 401 that is positioned above the bottom plug landing seat and extends into the interior area of the housing and is configured to engage with a top plug 404. The engagement of the top and bottom plugs with the corresponding landing seats is shown in FIG. 5.

It should be appreciated that one of the unique features believed characteristic of the present application is that the top plug is configured to land within the elongated body of the tool. This feature, along with the remaining configuration of the tool, provides a means for greatly reducing the length of the shoe track. This reduced length and inclusion of all components into one tool provides the well operator with forty or more feet of additional pay zone exposure. In addition, this eliminates up to six casing threads, as well as float collars, and landing collars, again greatly increasing the efficiency and reducing the cost associated with conventional systems.

Another unique feature of the present invention is that tool 201 does not require the cement integrity of the conventional methods, to withstand casing pressure tests. It should be appreciated that conventional cementing plugs cannot handle the high pressure of the casing pressure test, or hydraulic opening pressures of associated upstream tools such as toe initiator valves. However, the equipment of tool 201, provide a means to withstand the pressure during testing. Valves 407, 408 prevent formation fluids from entering the wellbore from below, and the top plug 404, which can be a 15 ksi latch down plug, allows for casing pressure tests and toe valve opening, without relying on shoe track cement integrity.

Figure 5:
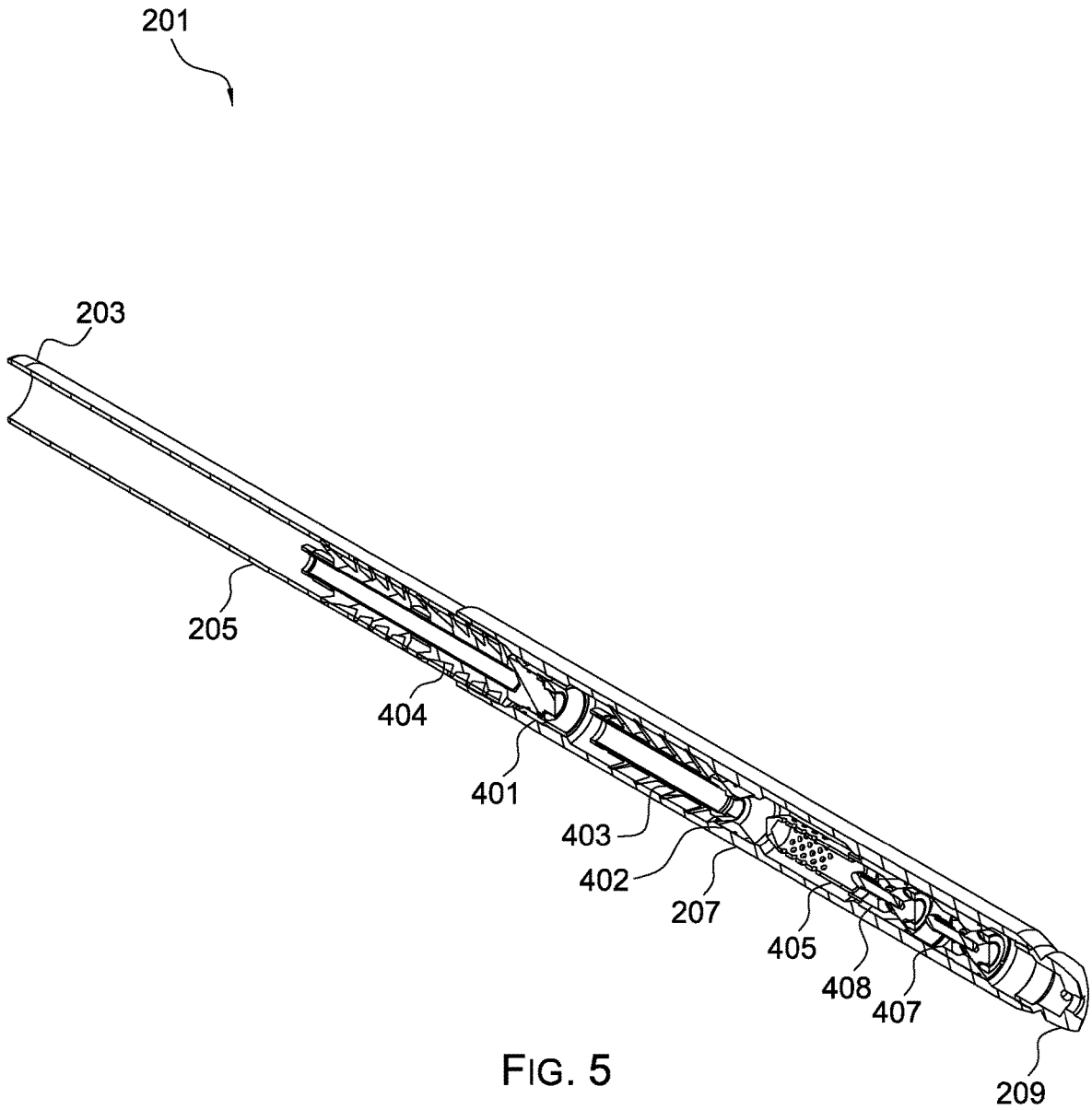
FIG. 5 is an isometric cross-sectional view of a shoe track assembly system with the tool of FIG. 2, a bottom plug, and a top plug in accordance with a preferred embodiment of the present application.

As also shown in FIGS. 4 and 5, the tool can further include a debris catcher system 405. This system can vary among debris catchers that are known in the art and provide a means to collect and store debris within the tool to help avoid and mitigate any damage from unwanted debris.

Figure 6:
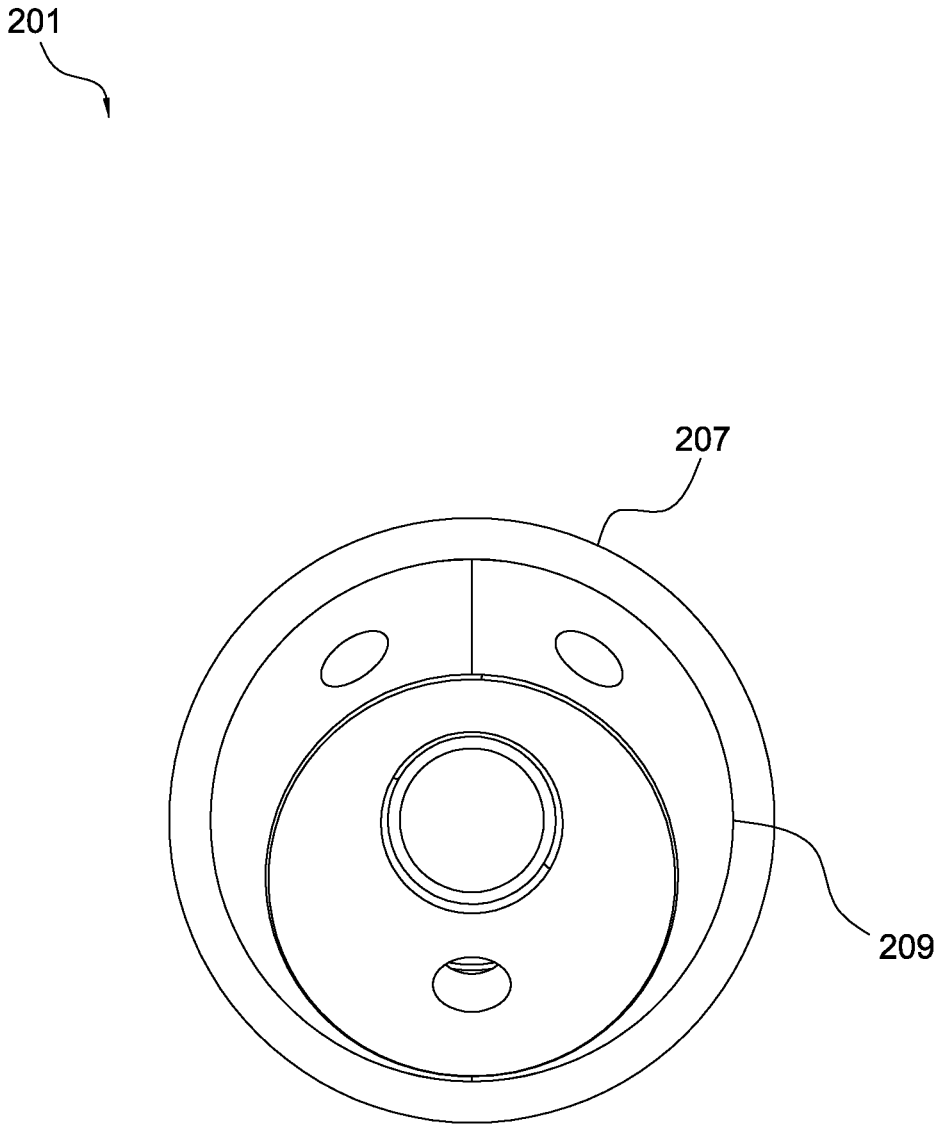
FIG. 6 is an end view of the tool of FIG. 2.

In FIG. 6, an end view of the tool 201 is shown for clarity, wherein guiding nose 209 is shown having a plurality of ports. Again, it should be appreciated and understood that the system could be altered with various guiding noses as desired.

Figure 7:
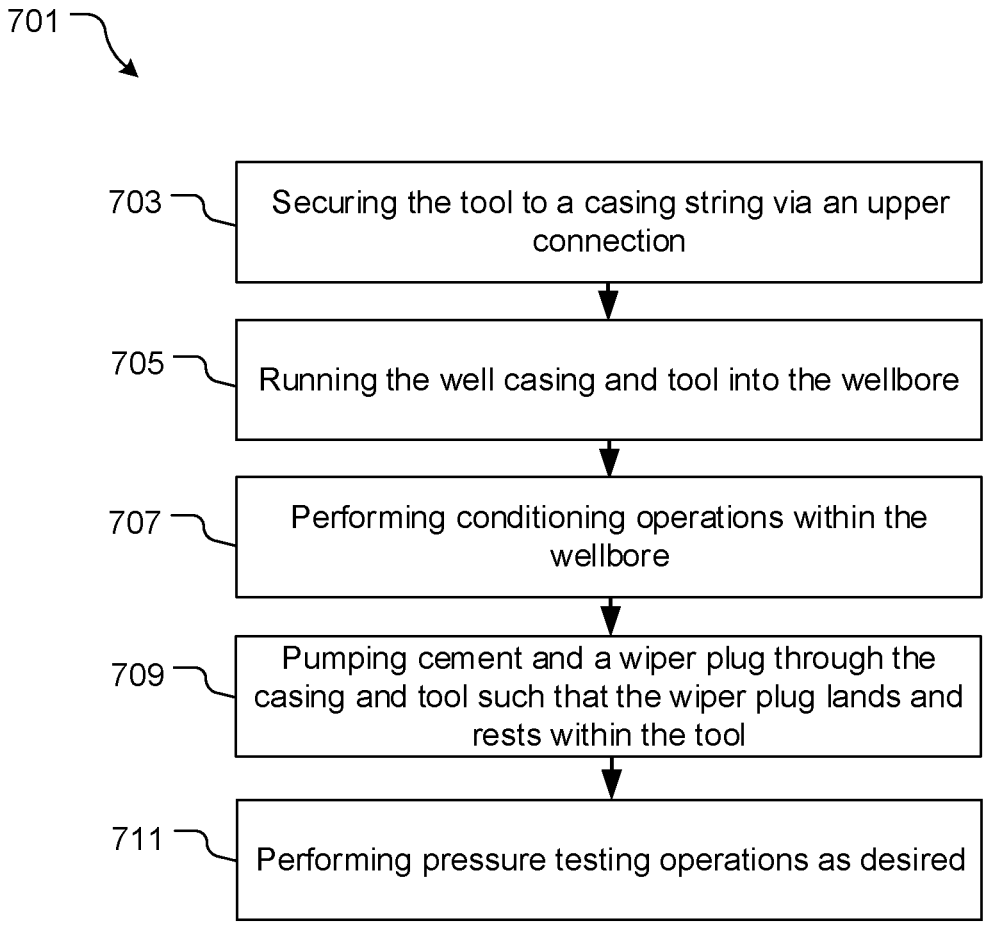
FIG. 7 is a flowchart of the method of use of the system of the present invention.

In FIG. 7, a flowchart 701 depicts a method associated with the present invention. During use, the tool 201 is secured to a lowermost casing string of the well casing, as shown with box 703. The well casing, along with the tool, is then run into the wellbore through conventional operations, as shown with box 705. The operator can then proceed to perform conditioning operations within the wellbore, wherein conditioning fluid is pumped through the tool, as shown with box 707. The operator can then pump cement and run one or more wiper plugs through the well casing, such that the one or more plugs engage with the landing seats of the tool, as shown with box 709. If desired, the user can perform pressure testing operations, wherein the tool is configured receive casing pressure testing without relying on shoe track cement integrity; and wherein the tool and plugs create a system configured to contain all required shoe track equipment as required by the operation, as shown with box 711

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A shoe track assembly system, comprising:

an elongated housing extending from a first end to a second end and having a guide nose engaged with the second end;

a first valve secured within the elongated housing and at a position directly above the guide nose;

a second valve disposed within the elongated housing and positioned above the first valve, the first and second valves are float valves;

a bottom plug landing disposed within the elongated housing and positioned above the second valve;

a top plug landing seat extending into the elongated housing at a position above the first valve, the second valve and the bottom plug;

wherein the system is configured to receive casing pressure testing without relying on a shoe track cement integrity; and wherein the system is configured to contain all required shoe track equipment as required by an operation.

2. The system of claim 1, further comprising:

a bottom plug configured to be dropped into the elongated housing and engage with the bottom plug landing seat.

3. The system of claim 1, further comprising:

a top plug configured to be dropped into the elongated housing and engaged with the top plug landing seat within the elongated housing.

4. The system of claim 1, wherein the first valve is a 15 ksi gas-tight float valve.

5. The system of claim 1, wherein the elongated housing is approximately five feet in length.

6. The system of claim 1, further comprising:

a debris catcher positioned within the elongated housing between the first valve and the top plug landing seat.

* * * * *